US005297652A

United States Patent [19]

Armond et al.

[11] Patent Number: 5,297,652

[45] Date of Patent: Mar. 29, 1994

[54] MOBILE TRANSCENDING SCAFFOLD APPARATUS

[76] Inventors: Alex Armond; Carolyn Armond, both of 1201 S. Prescott Dr., Morgan City, La. 70380

[21] Appl. No.: 909,304

[22] Filed: Jul. 6, 1992

[51] Int. Cl.[5] ..... E04G 1/20

[52] U.S. Cl. ..... 182/63; 182/127; 182/107

[58] Field of Search ..... 182/63, 2, 141, 127, 182/145, 107

[56] References Cited

U.S. PATENT DOCUMENTS 3,576,233 4/1971 Thatcher ..... 182/63
4,125,173 11/1978 Rust et al. ..... 182/63
4,614,251 9/1986 Hawkins ..... 182/63
4,817,758 4/1989 Gilmore ..... 182/63 X

*Primary Examiner*—Alvin C. Chin-Shue

[57] ABSTRACT

A mobile apparatus featuring framing for dual scaffolding and numerous other features that is equipped for highway towing to the job site, where it may be erected and towed with supporting equipment and supply trailers in a train-like fashion, with scaffolds erect on both sides of fences, levees or walls, to enable efficient cleaning, coating, maintenance or construction work to be performed simultaneously to all surfaces in a continuous efficient manner without the need to break down and re-erect equipment and scaffolds between progressive work areas.

3 Claims, 6 Drawing Sheets

Fig_5_
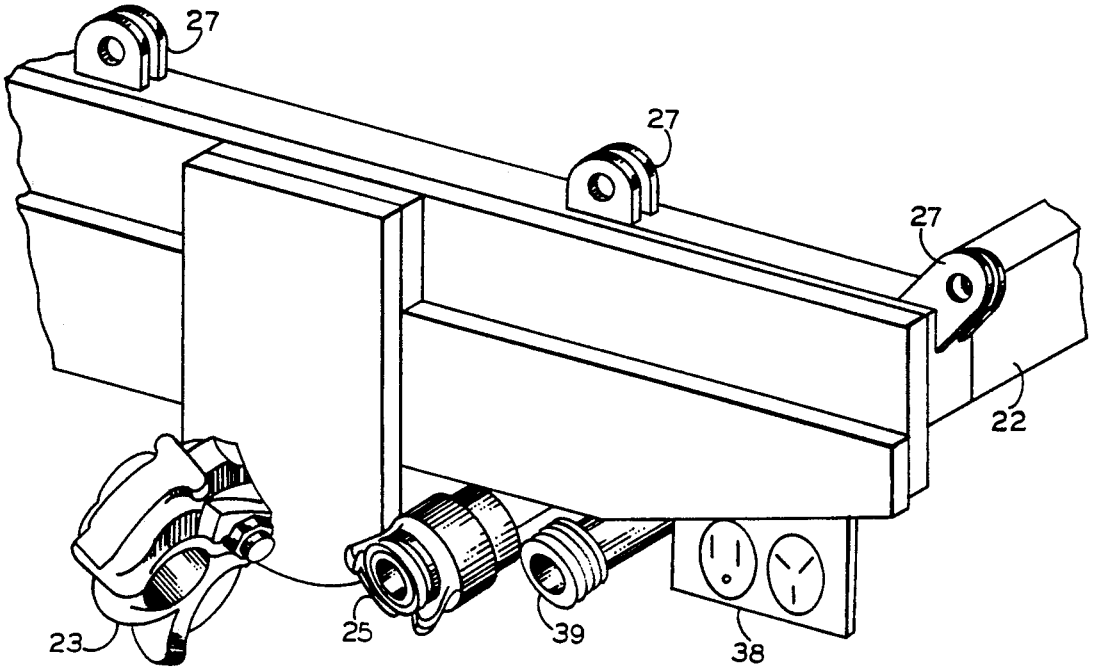
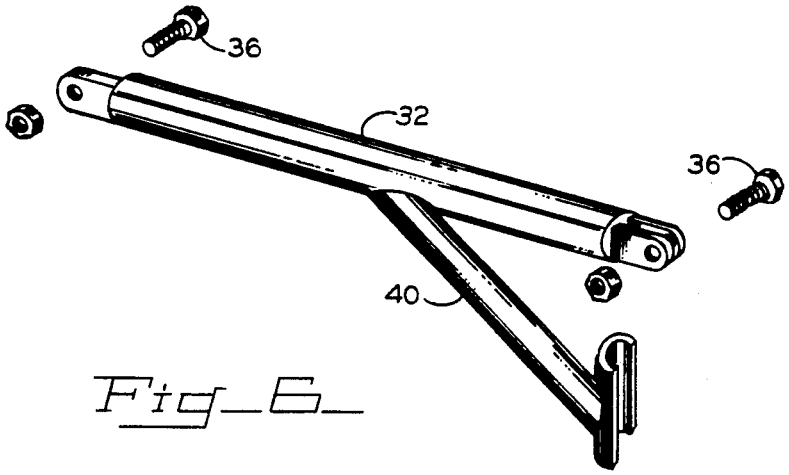
Fig_6_

Fig_7
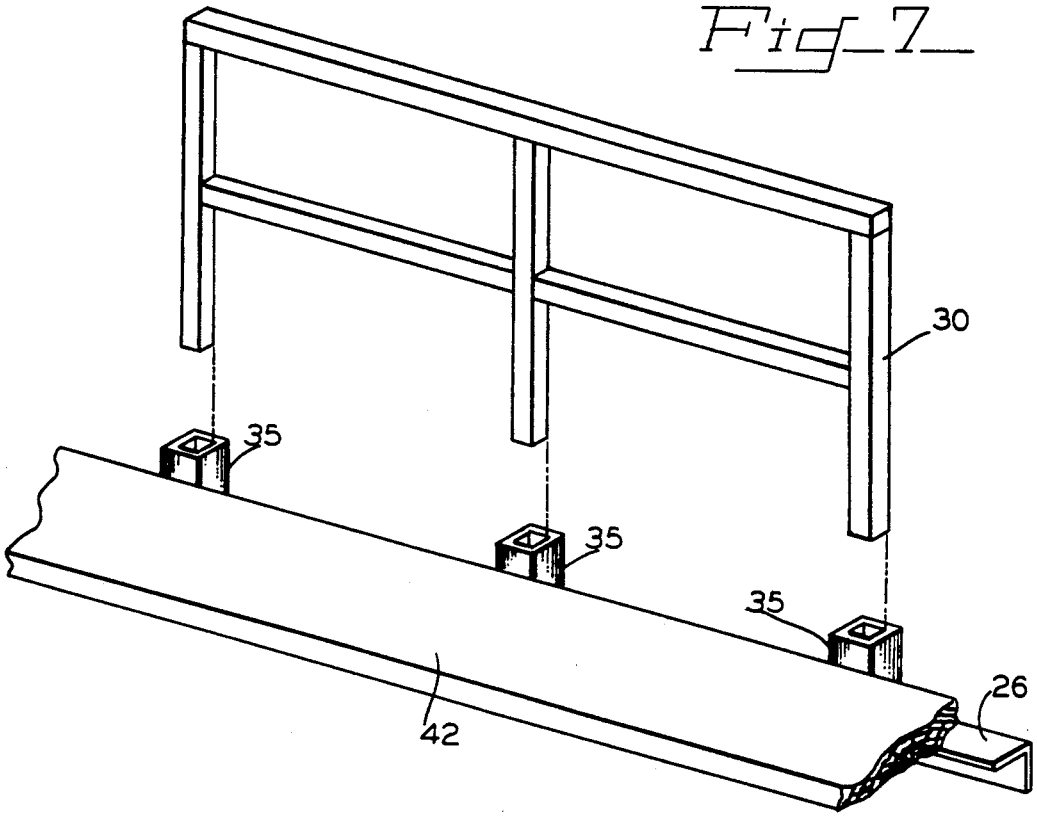
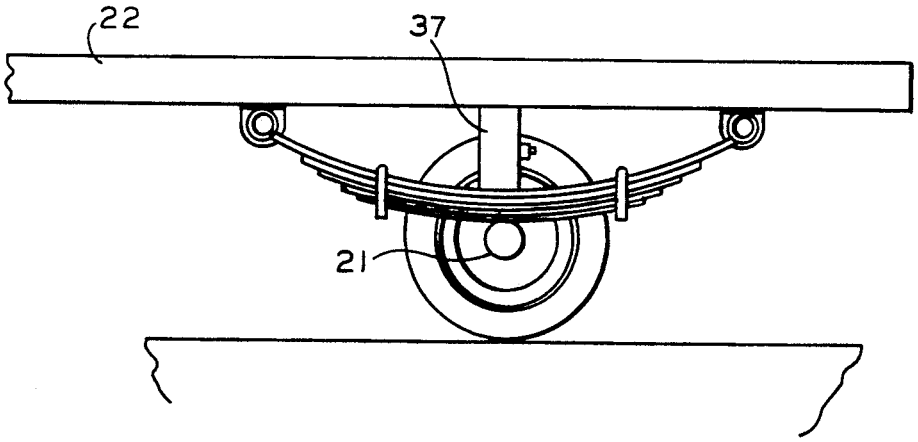
Fig_9

Fig_10_
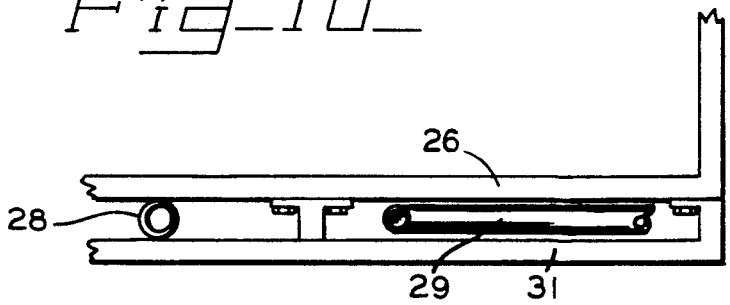
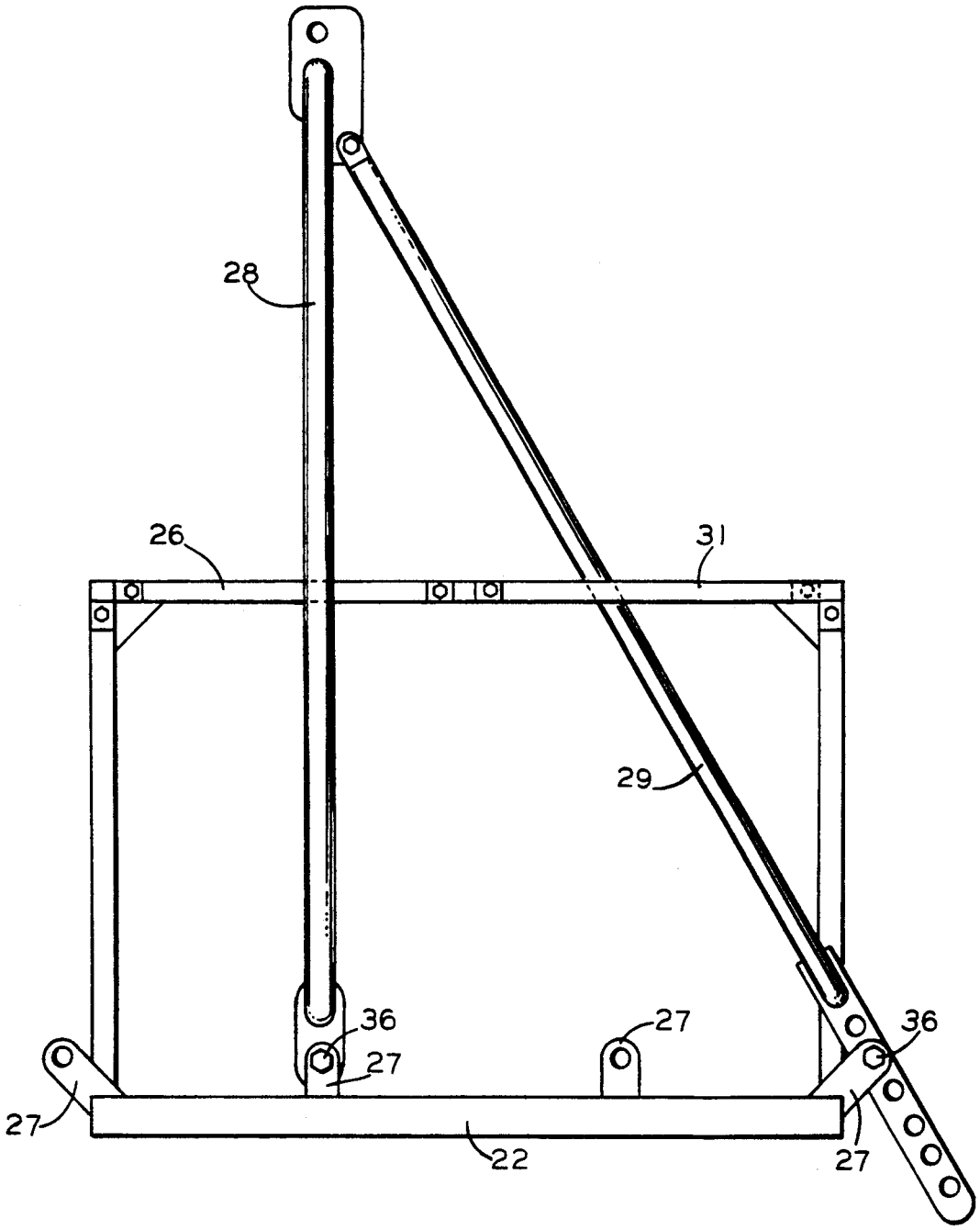
Fig_8_

MOBILE TRANSCENDING SCAFFOLD APPARATUS

FIELD OF THE INVENTION

This device relates to devices used to scaffold and provide mobile equipment and supplies for maintenance and construction work.

PRIOR ART

Numerous devices have been developed to improve scaffolding for bridges, buildings and other structures. Typical examples of those known devices are found in U.S. Pat. No. 3,854,550 dated Dec. 17, 1974 and issued to Shingler; U.S. Pat. No. 4,074,789 dated Feb. 21, 1978 and issued to Warren et al.; and U.S. Pat. No. 5,011,710 dated Apr. 30, 1991, and issued to Harrison. In all of the above, features were listed to enable scaffolds to be moved along one surface of job sites, where other equipment may be utilized. While those devices are very effective for their intended purposes, this invention adds several features for a different type of project. For years, the U.S. Corps of Engineers and many other developers have constructed levees and walls separating waterways from flood plains. In many cases, construction was performed using metal sheet piles or concrete walls. Usually, the levees or walls extend for long distances without large variations in height and width. As those structures age, cleaning, coating, maintenance and construction is required. To perform such work, scaffolds must be erected on each side and equipment and supplies delivered to each work area as work progresses. A great deal of efficiency is lost in the time and effort to dismantle scaffolds and relocate all scaffolds, equipment and supplies at the next work section. As opposed to prior devices, this invention is designed specifically for work on fences, levees and walls. Features included in this invention are: an apparatus having a wheel mounted frame and deck, with tongue steerinq and hitches on both ends; air or hydraulic deck levelers for uneven terrain; extension outriggers to transcend wall: dual sets of multi-level scaffolds (one fixed and one suspended to enable work to be performed simultaneously on both sides of the project); plane adjustments and stabilizers; a movable counterbalance ballast tank; removable hand rails; a reversible design for working from either side of said apparatus; a collapsing stow away design for highway towing: piped conduit with connectors to provide air, water, power, and supplies from support vehicles; a totally self-contained method of operating while towing other equipment and supply trailers in a train-like fashion; an outer jacket to permit all weather operations; and ground stabilizer pins to control sway of suspended scaffolds. The above invention is utilized as a dual sided multi-level mobile scaffold to encompass both sides of a fence, levee or wall project, capable of being towed in a completely self supported train-like fashion, to efficiently perform work without requiring interruptions to dismantle or erect scaffolds between progressive work areas, until the entire job is completed.

SUMMARY

This invention provides a completely mobile, highway towable, scaffold system that may be erected at job sites into a dual-sided, multi-level, movable scaffold designed to straddle and be towed along fence-like construction projects. The invention has a capacity to be totally self supporting when connected to support vehicles and towed, in a trainlike fashion, along continuous work areas. This invention eliminates the need to dismantle and/or re-erect scaffolds between progressive work areas.

DRAWINGS

Objectives and advantages of the invention become apparent from a study of the following description, taken with the accompanying drawings wherein:

FIG. 5 is an enlarged view of conduit connectors for air, water and power attached to frame next to rear hitch;

FIG. 6 is an enlarged view of a removable transcending outrigger;

FIG. 7 is an enlarged view of removable safety rails and sockets;

FIG. 8 is an enlarged view of an adjustable lateral support arm and horizontal sway guide railing;

FIG. 9 is an enlarged view of air(or hydraulic) lift springs to level deck on uneven terrain; and, FIG. 10 is a partial plan view of a horizontal sway guide railing.

PREFERRED EMBODIMENT

Figure 1:
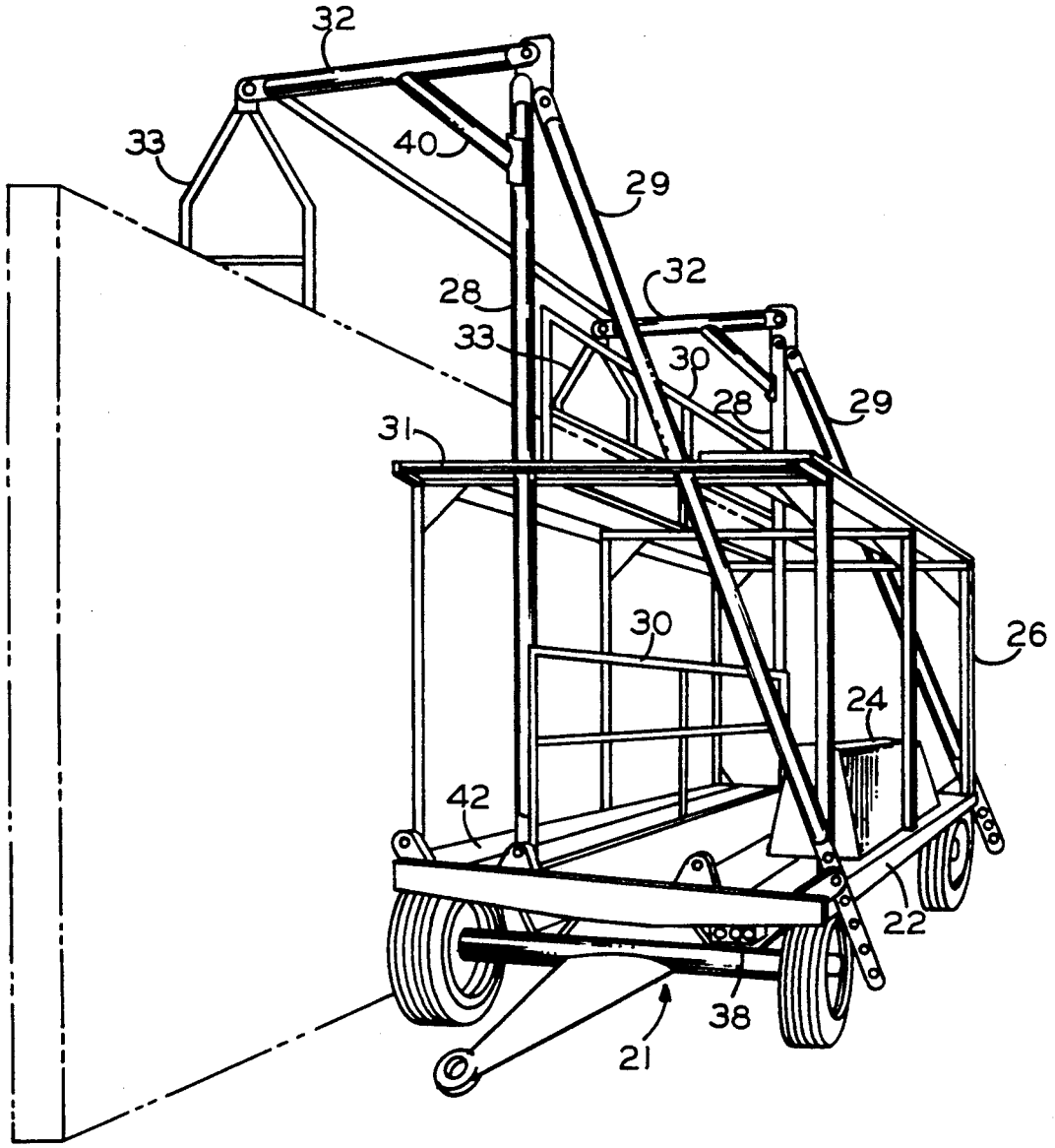
FIG. 1 is a perspective view of a mobile transcending scaffold apparatus with scaffolds embodying the principles of the present invention.

Referring to FIG. 1, a conventional set of tires, axles, springs and tongue steering is indicated at 21, to support frame 22. The frame is covered by a wooden deck 42. All components of the apparatus, excluding tires, wooden scaffolds and wooden deck, are generally constructed of steel, but aluminum or other materials may be substituted. A movable liquid filled ballast tank 24 is located on the deck to counter balance the apparatus. The apparatus will be towed in an erected state along work areas under construction or repair with additional trailers being towed to carry equipment and supplies in a train-like fashion. Air, water, power and other supplies may be piped from the support trailers through conduit connectors 25, 38 and 39 that are built into the frame of the invention. Conduits from said conduit connectors extend to the deck 42 and enables workers aboard the apparatus to have access to air, water, power and supplies while eliminating long, cumbersome and unsafe flexible hoses, piping and extension cords. Work may be performed on deck 42, or at higher levels using scaffold boards spanning scaffold rack 26. Additional multi-level scaffolds are suspended to hang on the opposite side of fence or wall work areas. The frame 22 has pad eyes 27 to attach rigging for hanging scaffold ladders 33 on either right or left side of the apparatus frame 22. The legs 28 are bolted to the inboard pad eyes so as to hinge and are held in lateral position by adjustable support arms 29 that are bolted to the outboard pad eyes. Guide railings 31 are bolted to the upper scaffold part of scaffold rack 26 to prevent horizontal sway of said legs 28. At the top of said legs, removable outriqqers 32 are bolted in position from which the outer set of scaffold ladders 33 may be suspended. A removable safety railing 30 is mounted at each scaffold level. When being transported to and from work locations, all non-welded parts of the apparatus may be dismantled and secured above deck 42 within frame 26 to permit apparatus to be towed on public highways.

Figure 2:
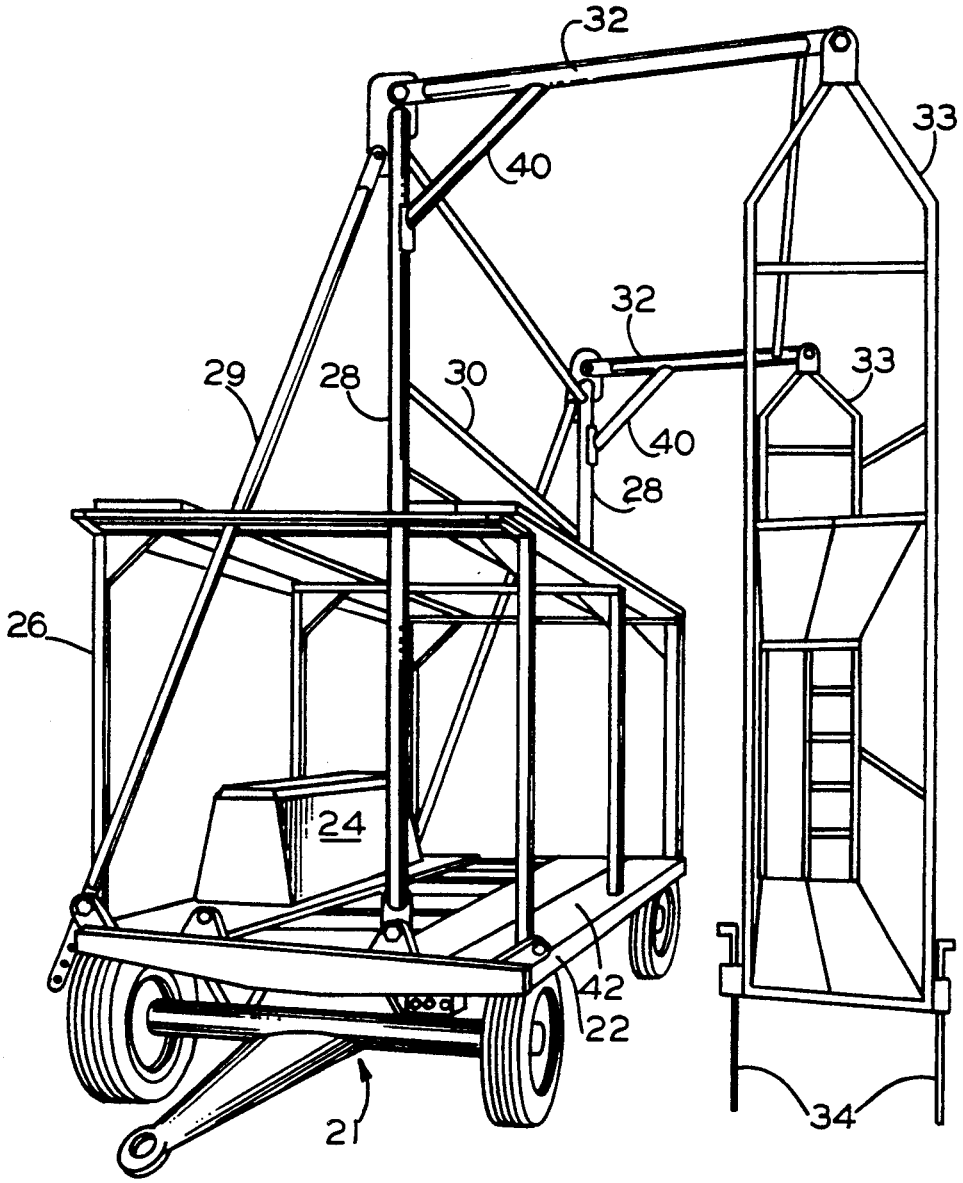
FIG. 2 is a perspective view similar to FIG. 1, with features erected in a reverse mode.

FIG. 2 illustrates the same configuration as FIG. 1, except that the apparatus is erected in reverse position.

Figure 3:
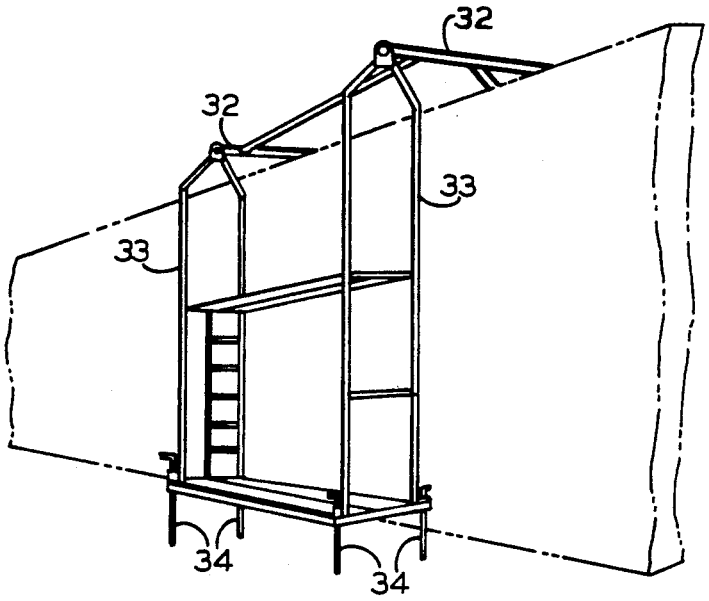
FIG. 3 is a view of the outrigger arms with the suspended scaffolds and ground stabilizer pins.

FIG. 3 illustrates a view of the suspended scaffold ladders 33 with scaffold boards from the opposite side of a wall from the main body of the apparatus. The suspended scaffold ladders are anchored to the ground by using stabilizer pins 34 in order to prevent sway. The pins will be locked in an upward position when the apparatus is being moved, and then stabbed into the ground at the next work position.

Figure 4:
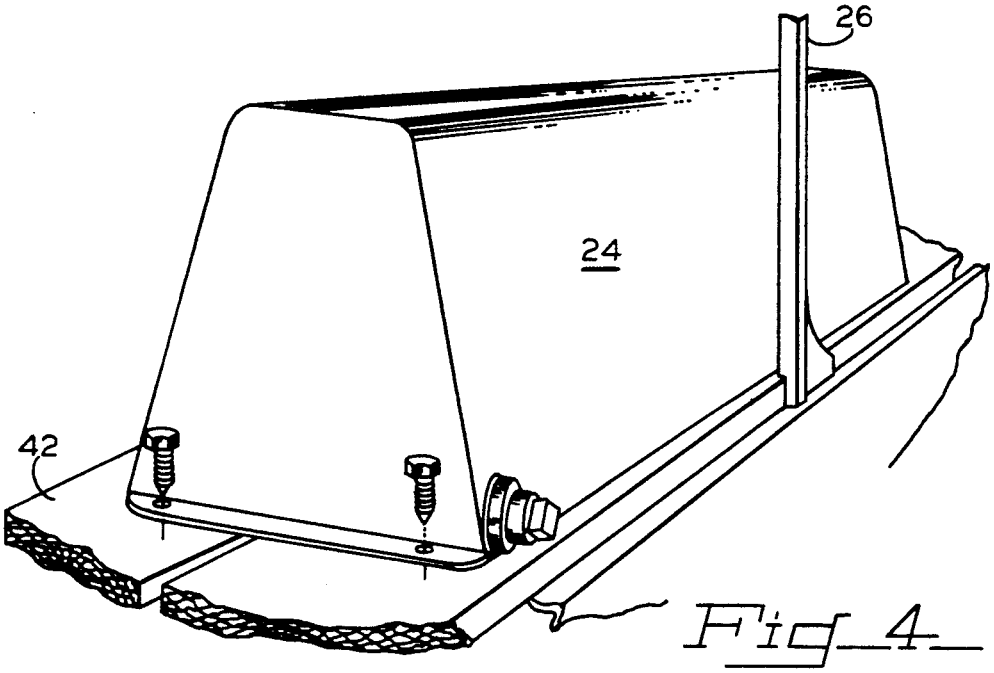
FIG. 4 is a view of the movable, liquid filled counterbalance ballast tank.

FIG. 4 is a liquid filled counterbalancing ballast tank 24 that is movable and may be bolted to the deck 42.

FIG. 5 illustrates conduit connectors 25, 38 and 39 to receive air 25, power 38 and air 39. The conduits are welded to the frame 22 and piped to the deck 42. Also shown is the rear trailer hitch 23 that is also welded to the frame.

FIG. 6 is an enlarged view of a removable outrigger 32 with connecting bolts 36. Outrigger 32 is supported by descending member brace 40.

FIG. 7 illustrates socket receptacles 35 welded to scaffold rack 26 or frame 22 and removable safety rails 30.

FIG. 8 is an enlarged end view showing pad eyes 27 and scaffold rack 26 welded to frame 22 with horizontal sway guide rail 31 bolted to scaffold rack 26. Also shown is the manner in which hinged support legs 28 and adjustable lateral support arms 29 are attached to removable bolts 36.

FIG. 9 shows adjustable air coil springs 37 which may be installed between axle springs of wheel mount 21 and frame 22 to enable deck 42 to be leveled when parked on uneven terrain.

FIG. 10 is a partial plan view of guide bar 31 bolted on the frame 26 reflecting the relative position it has with leg 28 and support arm 29.

This invention may vary in size, length, width and height, having two sets of multi-level scaffolds that may vary in number of levels, each from which work may be performed simultaneously by a group of workers; so as to facilitate various requirements of different projects.

I claim:

1. In combination with scaffold boards, an apparatus comprising: a set of wheels with two or more axles with steering connections to the front axle; a frame supported by said set of wheels; said frame including required lighting and other safety features; said frame including a rear trailer hitch; said frame covered with a wooden deck; said deck supporting a movable ballast tank that may be filled with various amounts of liquid for desired weight; said frame piped with various conduits having end connectors to provide flow of air, water, power and supplies from carried sources or from trailed vehicles; said frame including a scaffold rack to support the scaffold boards directly above either side of said frame; said frame also having pad eyes to attach reversible scaffold supports to enable suspended scaffolds to be erected on either side of said frame; said scaffold support having pin hinged legs attached to said pad eyes, and adjustable arms for lateral positioning to compensate for ground tilt of the frame; said scaffold supports having removable safety rails adjacent to said scaffold boards; said scaffold rack having guide railings to prevent horizontal sway of the support legs; said support legs supporting removable outriggers to transcend work projects; said outriggers supporting hanging scaffold ladders on a side of said work project opposite to said frame; said hanging scaffold ladders having ground stabilizer pins to eliminate sway; whereby, said apparatus may be towed to a job site in a partially disassembled form, erected at the job site into a towable scaffold system that is dual sided to straddle fence-like work projects, connected to other trailers carrying equipment and supplies, and towed in a train-like fashion along the project as work is performed without requiring dismantling and re-erection between progressive work areas.

2. An apparatus as described in claim 1 with all legs, arms, safety railings, outriggers and scaffold ladders being held in place by pins, sockets or bolts, so as to permit quick erection and dismantling at job sites and enable towing of the apparatus on public highways.

3. An apparatus as described in claim 1 with hydraulic or air lifts mounted between the frame and axle to maintain a level deck on uneven terrain.

* * * * *